US007037224B1

(12) United States Patent
Page et al.

(10) Patent No.: US 7,037,224 B1
(45) Date of Patent: May 2, 2006

(54) TRAINING BASKETBALL

(75) Inventors: Chris S. Page, Portland, OR (US); Paul A. Gaudio, Portland, OR (US); Geoffrey Charles Raynak, Lake Oswego, OR (US); Charles D. Kraeuter, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 10/295,763

(22) Filed: Nov. 14, 2002

(51) Int. Cl.
*A63B 69/00* (2006.01)

(52) U.S. Cl. ..... 473/596; 473/604

(58) Field of Classification Search ..... 473/596, 473/447, 450, 451, 280, 2, 52, 604, 605; 40/327; D21/707, 708, 712–714
See application file for complete search history.

(56) References Cited

U.S. PATENT DOCUMENTS

| | | | | |
|---|---|---|---|---|
| 676,506 | A * | 6/1901 | Knight et al. | 40/327 |
| 1,187,029 | A | 6/1916 | Beebout | |
| 1,705,096 | A | 3/1929 | Pierce | |
| 1,863,170 | A | 6/1932 | Scudder | |
| 1,890,566 | A | 12/1932 | Bartky | |
| 2,078,141 | A | 4/1937 | Hesper | |
| 2,091,455 | A | 8/1937 | Riddell | |
| 2,129,238 | A | 9/1938 | Riddell | |
| 2,352,872 | A | 7/1944 | Voit et al. | |
| 2,494,796 | A | 1/1950 | Brown | |
| 2,579,294 | A | 12/1951 | Brown | |
| 2,609,202 | A | 9/1952 | Winterbauer | |
| 2,623,747 | A | 12/1952 | Crowley | |
| 2,925,273 | A * | 2/1960 | Pratt | 473/451 |

(Continued)

FOREIGN PATENT DOCUMENTS

| | | |
|---|---|---|
| GB | 266507 | 3/1927 |

(Continued)

OTHER PUBLICATIONS

Photograph of "Spalding" ball which was on sale in this country at least one year prior to the filing date of the present application.

(Continued)

*Primary Examiner*—Steven Wong
(74) *Attorney, Agent, or Firm*—Banner & Witcoff, Ltd.

(57) ABSTRACT

A training game ball is described having cues for visually indicating the rotational alignment of the ball when it is thrown. If the ball is improperly thrown so that the axis of rotation does not stay perpendicular to the direction of flight, then the rotational alignment cue line will appear to wobble as the ball travels. The ball also has a rotational speed cue formed from a plurality of spaced panels arranged parallel with the alignment cue. If the ball is thrown with a high rotational speed, the panels will appear to the player as a solid line. Still further, the ball also includes hand alignment cues for assisting a player in properly positioning his or her hands for throwing the ball. The hand alignment cues include finger positioning pads, which are positioned sufficiently close together about the circumference of the ball to allow even a small youth's hand to easily reach a finger positioning pad from any position of the ball. The hand alignment cues may also include a stabilizing hand positioning mark located over one or both opposite poles of the ball. Each of the cues may have a different appearance, so that they may be visually distinguished. The hand alignment cues may also have a different surface to provide a tactile indication of their location to a player.

41 Claims, 2 Drawing Sheets

U.S. PATENT DOCUMENTS

| | | | | | |
|---|---|---|---|---|---|
| 3,119,618 | A | | 1/1964 | Molitor et al. | |
| 3,506,265 | A | | 4/1970 | Yugi | |
| 3,858,876 | A | | 1/1975 | Williams | |
| 3,863,923 | A | | 2/1975 | Anderson | |
| D248,986 | S | * | 8/1978 | Nakata | D21/713 |
| 4,258,921 | A | * | 3/1981 | Worst | 40/327 |
| 4,345,759 | A | | 8/1982 | Nims | |
| 4,546,975 | A | | 10/1985 | Nims | |
| 4,772,020 | A | | 9/1988 | Martin | |
| 4,887,814 | A | | 12/1989 | Winter | |
| 4,928,962 | A | | 5/1990 | Finley | |
| 4,936,577 | A | | 6/1990 | Kington et al. | |
| 5,067,719 | A | * | 11/1991 | Mook | 40/327 |
| D322,105 | S | | 12/1991 | Ma | |
| 5,133,550 | A | | 7/1992 | Handy | |
| D329,673 | S | | 9/1992 | Williams | |
| D329,674 | S | | 9/1992 | Williams | |
| 5,163,680 | A | | 11/1992 | Amron | |
| 5,165,685 | A | | 11/1992 | Hynes | |
| D335,906 | S | | 5/1993 | Hellerman | |
| 5,224,704 | A | | 7/1993 | Snell | |
| D351,203 | S | | 10/1994 | Handy | |
| D355,230 | S | | 2/1995 | Brown | |
| D365,862 | S | | 1/1996 | Shishido et al. | |
| 5,564,707 | A | * | 10/1996 | Dinh | 40/327 |
| 5,570,882 | A | | 11/1996 | Horkan | |
| D382,927 | S | | 8/1997 | McGowen et al. | |
| 5,676,611 | A | | 10/1997 | Foster et al. | |
| 5,709,623 | A | | 1/1998 | Schwaner | |
| 5,807,198 | A | | 9/1998 | Grimm | |
| D408,482 | S | | 4/1999 | Morrison | |
| 5,931,752 | A | | 8/1999 | Guenther et al. | |
| 5,961,407 | A | | 10/1999 | Spiegel | |
| 5,984,812 | A | * | 11/1999 | Sassak | 473/596 |
| 6,099,423 | A | | 8/2000 | Ou | |
| 6,123,633 | A | | 9/2000 | Guenther et al. | |
| 6,200,239 | B1 | | 3/2001 | Kennedy, III et al. | |
| D462,732 | S | | 9/2002 | Morrison et al. | |
| D485,316 | S | * | 1/2004 | Poegel, Jr. | D21/714 |
| D485,590 | S | * | 1/2004 | Poegel, Jr. | D21/714 |
| 6,752,732 | B1 | | 6/2004 | Morrison et al. | |

FOREIGN PATENT DOCUMENTS

| | | |
|---|---|---|
| GB | 772449 | 4/1957 |

OTHER PUBLICATIONS

Photograph of "Black Bomb" ball which was on sale in this country at least one year prior to the filling date of the present application.

Photograph of "Playoff" ball which was on sale in this country at least one year prior to the filing date of the present application.

Photograph of "Zwirl" ball which was on sale in this country at least one year prior to the filing date of the present application.

Photograph of "Pool" ball which was on sale in this country at least one year prior to the filing date of the present application.

Photograph of "Sunburst" ball which was.on sale in this country at least one year prior to the filing date of the presnt application.

Photograph of "Gripper" ball which was on sale in this country at least one year prior to the filing date of the present application.

* cited by examiner

FIG.1
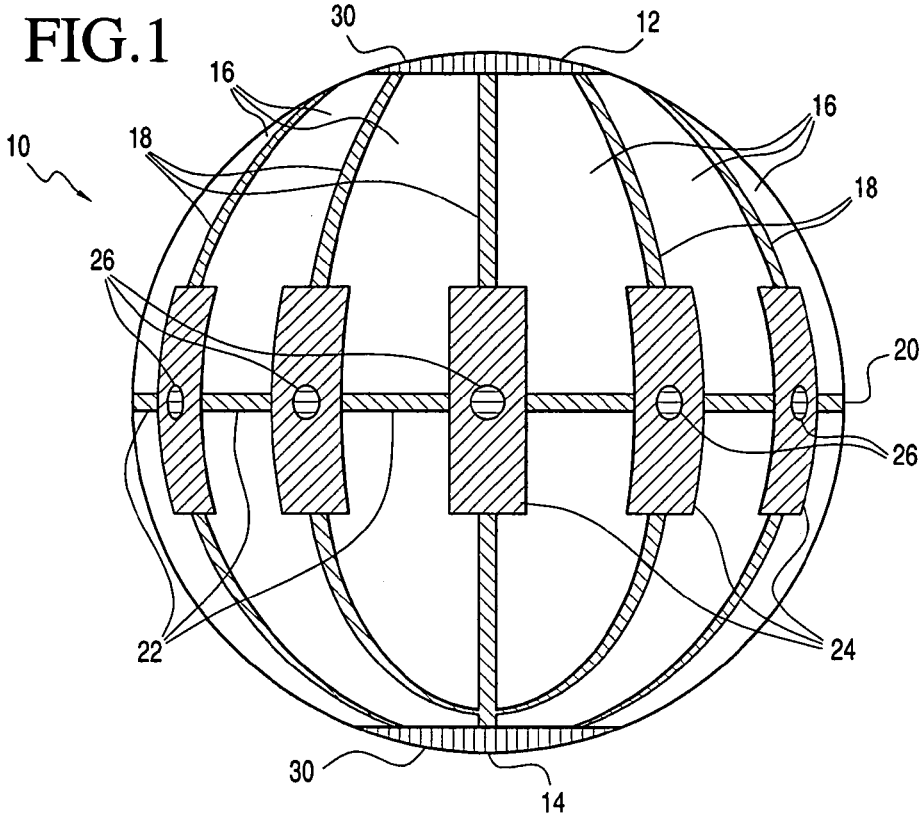
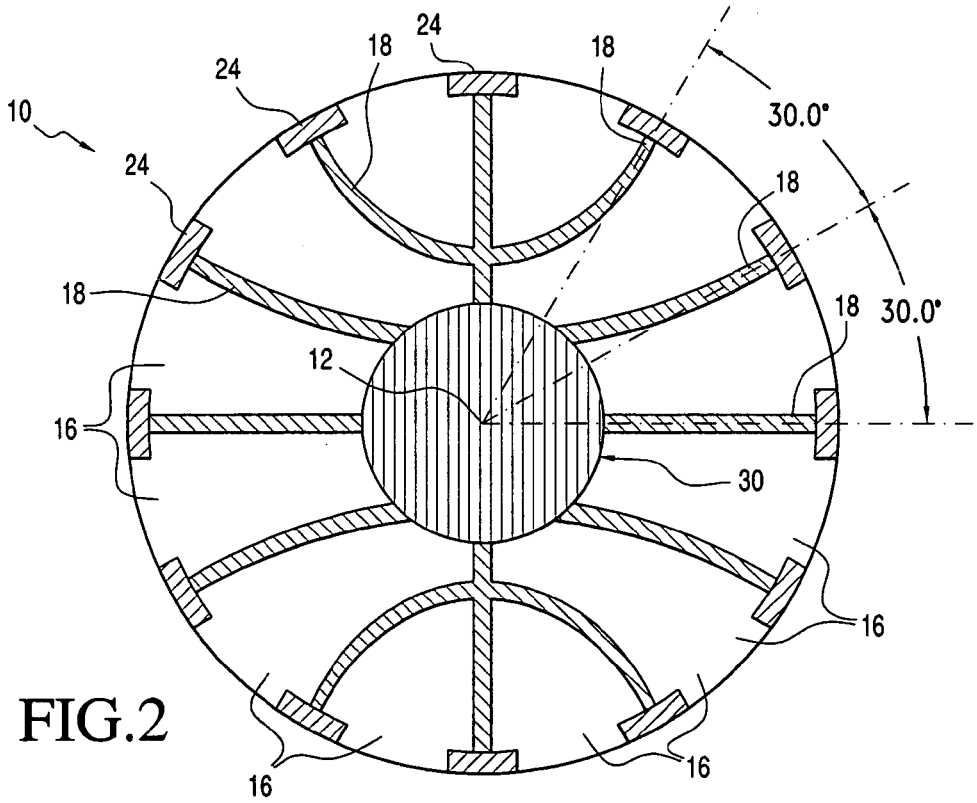
FIG.2

TRAINING BASKETBALL

FIELD OF THE INVENTION

The present invention relates to a game ball, such as a basketball, having a plurality of panels. Further, the invention relates to a game ball having a rotational alignment cue and a separate rotational speed cue, so that a user may accurately judge both the straightness and rotational speed of the use of the game ball. The invention also relates to a game ball having hand alignment cues, so that a user may properly locate his or her hands for throwing the ball.

BACKGROUND OF THE INVENTION

It is not uncommon for sporting equipment balls to have special training features for improving a player's performance and accuracy. For example, in many sports, it is important that a user be able to throw or kick a ball so as to properly align it with a hole, a hoop, a net, or other target for purposes of scoring in a game. Training to properly kick or throw a ball is particularly important for younger players, such as teenagers and adolescents, as these age groups are still developing their playing skills.

In many sports, including basketball, accuracy of a thrown ball or "shot" is affected by the ball's rotation. The rotation of a ball can generally be segregated into two components: speed of rotation and alignment of the ball. The speed of rotation is how fast the ball is revolving about an axis, while alignment relates to the degree to which the angle of that axis remains constant relative to the direction of the flight of the ball toward the target. To some extent, these components are related, as a faster rotational speed helps to maintain a ball's alignment.

Visual and tactile features on a ball can aid a user in obtaining the proper alignment when throwing a ball. Thus, these features can be useful training tools, even if they may not be permitted in an official game. Basketball players have been particularly interested in improving their accuracy with a basketball, as the game of basketball requires a player to throw or "shoot" the ball through a hoop not much larger than the ball itself to score. Some types of basketballs have employed markings in the shape of a hand to teach proper placement of the player's hand on the ball for shooting a basket. One example of this type of basketball is shown in U.S. Pat. No. 3,858,876 to Williams. This type of hand placement marking, however, does not help a player to judge either the rotational speed of the ball when thrown, or the accuracy of the ball's alignment during flight. Further, it does not tactilely assist a user in positioning his or her hands to throw the ball.

Still other basketballs provide a single circumferential line on a ball. This type of line may be used to assist a player in aligning the ball with an intended line of travel to a target. While this type of line can inform a player of the ball's rotational alignment, the use of only a single line to provide this information does not assist a player in visually discerning the separate physical components of rotational speed and alignment of a shot in order to effectively recommend improvement to a player.

Accordingly, it would be beneficial to have a game ball that assists a player in both detecting alignment of the ball during flight and detecting the rotational speed of the ball during flight in such a way that both alignment and rotational speed can be separately evaluated and adjusted to improve a player's shooting performance. Moreover, it would be useful to have a game ball that provides a user with guidance as to hand placement when throwing the ball. Still further, it would be beneficial to have a game ball that makes these training features available to younger players, who are still developing their skills and thus will obtain the most benefit from these training features.

SUMMARY

Various embodiments of the invention advantageously relate to a game ball having segregated markings for indicating both the rotational speed and rotational alignment of a ball when thrown. More particularly, a game ball according to some embodiments of the invention may include a rotational alignment cue, such as one or more lines extending about its circumference. The line or lines can be solid, or made up of a plurality of line segments. If the rotational alignment cue is aligned with a hoop or other target before the ball is shot, it will stay in alignment with the target if the ball is properly shot. If, however, the ball is improperly shot, so that the axis of rotation of the ball does not stay aligned relative to the direction of flight, then the rotational alignment cue line will appear to wobble as the ball travels.

A ball according to various embodiments of the invention may also include a rotational speed cue, which may be formed from a plurality of spaced markers or other indicia arranged parallel with the rotational alignment cue. The markers or other indicia are positioned such that, if the ball is thrown with a high rotational speed, the markers will appear to the player as a solid line. If, however, the ball is shot with a low rotational speed, then the player will be able to individually distinguish the markers during flight. With some embodiments of the invention, the plurality of markers forming the rotational speed cue are be wider than the rotational alignment cue, be of a different color than the rotational alignment cue, or otherwise have a different appearance than the rotational alignment cue, so that a player or coach can easily distinguish between the rotational alignment and rotational speed of a shot while the ball travels to the target.

Still further, with some embodiments of the invention the ball may include a plurality of hand alignment cues for assisting a player in properly positioning one or both of his or her hands for shooting the ball. The hand alignment cues may have a texture that is different from other surface areas of the ball, to help a player tactilely locate the hand alignment cues. Further, with some embodiments of the invention, the hand alignment cues may also have finger pads for aligning the fingers of the player's shooting hand with the center circumference of the ball. The hand alignment cues may be positioned sufficiently close together about the circumference of the ball to allow even a small youth's hand to easily reach a hand alignment cue from any position of the ball. The hand alignment cues may also include markers to assist a player in properly positioning his or her supporting hand for a shot.

Various advantages and features of novelty that characterize the invention are pointed out with particularity in the claims. For a better understanding of the invention, however, reference should be made to the drawings and to the accompanying descriptive matter.

BRIEF DESCRIPTION OF THE DRAWINGS

FIG. 1 is a side view a ball according to one embodiment of the invention having rotational speed cues, a rotational alignment cue, and hand alignment cues;

FIG. 2 is a top view of the ball shown in FIG. 1;

DETAILED DESCRIPTION OF THE INVENTION

Figure 3:
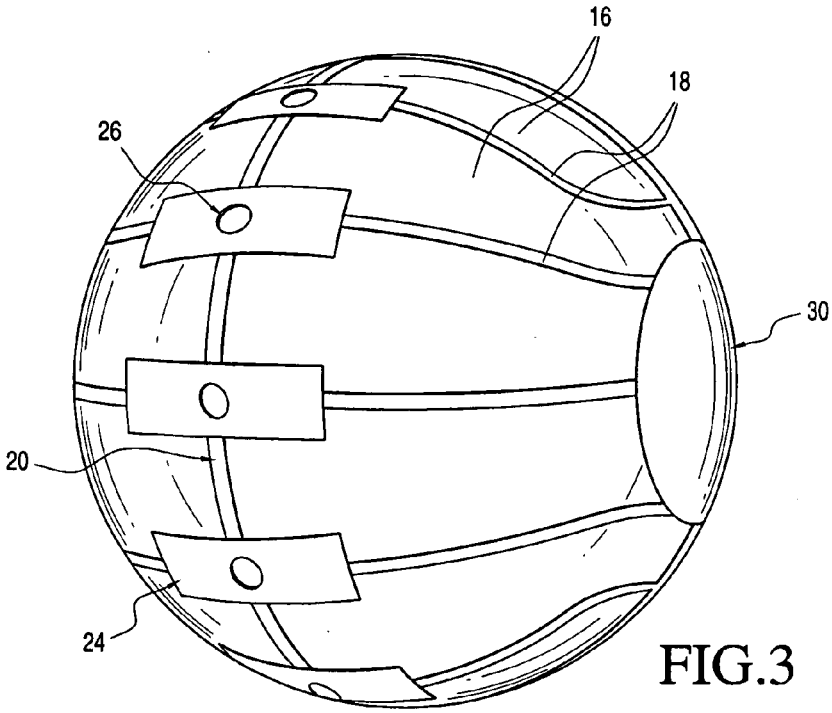
FIG. 3 is a perspective view of the ball shown in FIG. 1.

FIG. 1 illustrates a basketball 10 according to one embodiment of the invention. As seen in this figure, the basketball 10 has a first pole 12 and a second pole 14. A series of connected panels 16 running longitudinally between the first pole 12 and the second pole 14 then forms the body of the basketball 10. In particular, as shown in FIG. 2, the basketball 10 is made up of twelve panels 16, but various embodiments of the invention may employ more or fewer panels. For example, some embodiments of the invention may employ 6, 8, or 9 or more panels 16. As will be discussed in detail below, having more than the 8 panels of a conventional basketball allows the training features of a basketball according to the invention to be more accessible to younger players with smaller hands. At the widest circumference between the poles 10 and 12 (that is, at the equator of the ball 10), the widths of the panels 16 are equal. Thus, the seams 18 formed between two adjacent panels 16 in the illustrated embodiment are spaced at regular intervals of 30° about the equator of the ball 10.

Returning now to FIG. 1, the basketball 10 includes a rotational alignment cue 20, which appears as a narrow line or stripe encircling the ball 10 about its equator. In the illustrated embodiment, the rotational alignment cue 20 is a segmented line formed of segments 22, which are equally spaced about the equator of the ball 10. With other embodiments of the invention, however, the rotational alignment cue 20 may be a continuous line. With still other embodiments of the invention, the alignment cue 20 may be formed from two or more parallel and continuous or segmented lines.

In the illustrated embodiment, each of line segments 22 is similar in width to the seams 18. For example, the line segments 22 may have a width of about ⅜ inch (about 5.0 mm), while seams 18 may have a width of about 7/16 inch (about 6.0 mm). Of course, it should be appreciated that the width of the line segments 22 may be wider or narrower, as desired. Further, if the rotational alignment cue 20 is formed from a continuous line, or from multiple continuous and/or segmented lines, then these lines may have any suitable width.

The basketball 10 also includes a plurality of separate rotational speed cues or markers 24. The markers 24 are positioned parallel with the rotational alignment cue 20, and are equally spaced about the equator of the ball 10. As will be discussed in detail below, for various embodiments of the invention, the markers 24 are positioned such that, when the ball is thrown or kicked so that the ball rotates at a minimum desired speed, the markers 24 will appear to the human eye to form a single line. If, however, the ball is thrown or kicked so that the ball rotates below the minimum desired speed, the markers 24 will still be separately distinguishable. For example, with the basketball 10, the markers 24 may be positioned such that, when the ball 10 rotates at approximately 120 rpm, the markers 24 will appear to form a single line. If the ball 10 is thrown at only 100 rpm, however, then the markers 24 will still be separately distinguishable by an onlooker.

In the embodiment illustrated in FIG. 1, each marker 24 is centered on the rotational alignment cue 20. Further, each marker 24 has a rectangular shape with its long edge or axis transverse to the rotational alignment cue 20. While the straight ends of the rectangular shape are easier for some viewers to track, with alternate embodiments of the invention the markers 24 may have any desirable shape. Thus, the markers 24 may be oval, rectangular with indentations, protuberances, shaped edges, or any other suitable shape.

Still further, the markers 24 may be formed in pairs, with the markers 24 of each pair being positioned at an equal distance to either side of the rotational alignment cue 20. Of course, the markers 24 may be arranged in larger groups equally spaced about the equator of the ball 10. For example, if the rotational alignment cue 20 is formed of two or more continuous or segmented lines, then a group of markers 24 could be positioned such that a marker 24 is located on each side of the rotational alignment cue 20 lines.

With various embodiments of the invention, the markers 24 are significantly wider than the rotational alignment cue 20, so that the markers 24 may be more easily distinguished from the rotational alignment cue 20. In the illustrated embodiment, for example, each marker is approximately 1.0 inch long in the direction parallel to the rotational alignment cue 20, and about 3.0 inches long in the direction transverse to that of the rotational alignment cue 20. As will be explained in detail below, the greater width of the markers 24 than the rotational alignment cue 20 will allow a player or observer to readily distinguish the markers 24 from the rotational alignment cue 20 when the ball is thrown.

It should be appreciated, however, that the dimensions of the markers 20 may vary, and need not be significantly wider than the rotational alignment cue 20. For example, with some embodiments of the invention, the markers 24 may be much longer in the direction parallel to the rotational alignment cue 20, and narrower in the direction transverse to that of the rotational alignment cue 20. With still other embodiments of the invention, the markers 24 may be very narrow in the direction parallel to the rotational alignment cue 20, and much wider in the direction transverse to that of the rotational alignment cue 20.

The ball 10 may further include hand alignment cues, for assisting a player to properly position his or her hands on the ball when making a shot. As will be appreciated by those of ordinary skill in the art, one desirable hand position for throwing a basketball is with the fingers of the player's throwing hand positioned along or close to the seams of the basketball. Accordingly, the hand alignment cues of the ball 10 may include finger-positioning pads 26, to assist a player in correctly positioning the fingertips of his or her throwing hand on or close to the seams 18 of the ball 10.

In the illustrated embodiment, for example, the hand alignment cues include finger-positioning pads 26 located at each intersection of the equator of the ball 10 with a seam 18. Each finger-positioning pad 26 indicates a position at which the user may place the middle finger of his or her throwing hand to ensure that his or her fingertips are on or near a seam 18. Alternatively, a user may place may place his or her index finger and middle finger (or middle finger and ring finger) on either side of a positioning pad 18. With still other embodiments of the invention, the hand alignment cues may include a group of two or more finger-positioning pads 26 located at each intersection of the equator of the ball 10 with a seam 18. For example, some embodiments of the invention may have a pair of finger-positioning pads 26 located at each intersection of the equator of the ball 10 with a seam 18, one finger-positioning pad 26 positioned on either side of the equator. Thus, the finger-positioning pads 26 indicate to a player where the player should place his or her fingertips when shooting the ball.

Advantageously, because the ball 10 has more than the conventional number of panels 16 and corresponding seams 18, the finger-positioning pads 26 occur frequently enough along the equator of the ball 10 so that even a youth's smaller fingers can easily locate a finger-positioning pad 26 from most locations, without the user having to readjust the position of the ball 10. For example, by having 12 panels rather than the 8 panels typically employed with conventional basketballs, youths of all ages can easily employ the positioning pads 26 to position their fingertips on or near a seam 18 of the ball 10. It should be noted that, while the illustrated embodiment of the invention has 12 panels, still other embodiments of the invention may have 9, 10, 11 or more than 12 panels.

The finger-positioning pads 26 may have a different surface texture than the other surfaces on the ball 10, and may additionally or alternately be recessed to form a dimple in the ball 10 or raised to form a bump on the ball 10. Providing a distinctive texture for one or more of the finger-positioning pads 26 and/or providing a recess or raised area corresponding to one or more of the finger-positioning pad 26 serves to aid a player in tactilely locating the proper shooting hand position. Thus, a player will be able to use the distinctive texture, recess or raised area to quickly position his or her middle finger over a finger-positioning pad 26 without having to actually take the extra time to look at the basketball 10. If the ball 10 includes an air valve for inflating the ball 10, this valve may be conveniently located at one of finger-positioning pads 26, to improve the aesthetic appearance of the ball 10.

As will also be apparent from FIG. 1, by positioning the finger-positioning pads 26 in the seams 18 along the rotational alignment cue 20, the finger positioning pads 26 are located in the center of the markers 24. Accordingly, the markers 24 may also be configured to assist a player in correctly positioning his or her fingertips close to a seam 18. For example, the markers 24 may have a texture that is different from a majority of the surface area of the ball 10. This difference in surface texture may also help a player to tactilely locate the rotational speed marker 24, and thus its associated finger-positioning pad 26.

Figure 4:
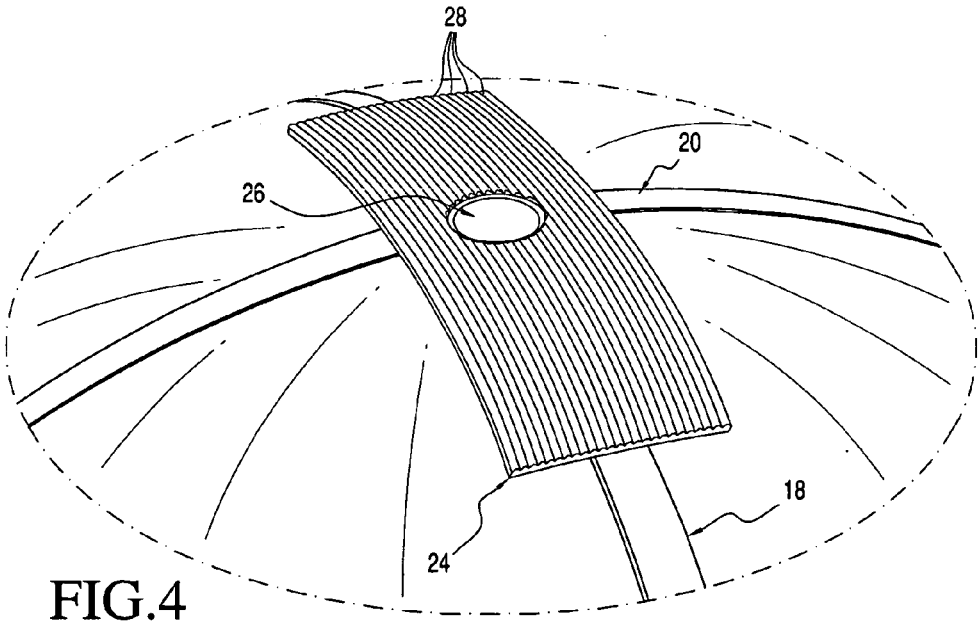
FIG. 4 is an enlarged view of the region encircled in FIG. 1.

The texture can be formed by, for example, a plurality of ridges 28, such as those schematically illustrated in FIG. 4. The ridges 28 may be, for example, about 1/64 inches (about 0.5 mm) in height and transversely positioned in relation to rotational alignment cue 20. In addition to helping the player tactilely identify the marker 24, this type of texture will also improve the player's grip to maximize rotational spin of ball 10 when thrown. Of course, still other types of surface textures can be used to assist a player in tactilely locating a convenient marker 24 (and thus a close finger-positioning pad 26).

In addition to the finger-positioning pads 26, the hand alignment cues may also include a stabilizing hand positioning mark 30 at one or both poles 12 and 14. As will be appreciated by those of ordinary skill in the art, when a basketball is properly thrown, the stabilizing hand should have little effect on the trajectory of the ball. Accordingly, the stabilizing hand positioning marks 30 are located over the poles 10 and 12, where positioning a user's hand will not have a great impact on the rotational alignment and speed of the ball 10 when thrown.

Thus, a user may shoot the ball 10 by placing fingers of a left hand at one of the finger-positioning pads 26 and a right hand over a stabilizing hand positioning mark 30, or shoot the ball by placing fingers of a right hand at one of the finger-positioning pads 26 and a left hand over a stabilizing hand positioning mark. Like the markers 24, the stabilizing hand positioning marks 30 may have a different surface texture than the rest of the ball 10. For example, the stabilizing hand positioning marks 30 may have a smooth surface, a slightly indented surface, or other tactile identifier. If the stabilizing hand positioning marks 30 are formed with a smooth surface, however, then the stabilizing hand may be less likely to influence the shot due to the lower coefficient of friction.

When a player wishes to use the basketball 10 for training, the player first positions the basketball 10 for a shot. Using the distinctive texture of the markers 24, or the distinctive texture or dimpling of the finger-positioning pads 26, a player can quickly position his or her fingers using a finger-positioning pad 26 without even looking at the basketball 10, as described above. Moreover, because of the large number of panels 16 and seams 18, even a youth with small hands will be able to quickly and properly place his or her fingers using a positioning pad 26 without having to significantly reposition the basketball 10. As previously noted, by using a positioning pad 26, the player can place the fingertips of his or her throwing hand at the recommended location on or near a seam 18. The player can then position his or her stabilizing hand at a pole 12 or 14 of the basketball 10 using the stabilizing hand positioning marks 30.

Once the player has used the hand alignment cues to properly align his or her hands on the ball 10, the player then vertically aligns the alignment cue 20 with a target, and shoots the ball 10 toward that target. As the ball 10 rotates about its rotational axis (that is, the axis perpendicular to the plane formed by the alignment cue 20), the alignment cue 20 will also rotate about the ball's rotational axis. If the ball 10 is thrown with the proper alignment, the alignment cue 20 will not appear to move from an observer's perspective. On the other hand, if the ball 10 is thrown without the proper alignment, then the alignment cue 20 will appear to wobble back and forth over the trajectory to the target. Advantageously, because the alignment cue 20 illustrated in FIG. 1 is narrow, even slight wobbling of the alignment cue 20 can easily be distinguished. If, however, viewability at greater ranges is desired, then the alignment cue 20 can be widened so that it may be more easily seen at a distance.

As will be appreciated by those of ordinary skill in the art, when the player throws the ball 10, the rotational speed cues or markers 24 will also rotate about the ball's rotational axis. If the ball 10 is thrown with a high rotational speed, as is desirable, then to an observer the individual markers 24 will appear to blend together to form a single ring. If, however, the ball is thrown with a low rotational speed, then an observer will still be able to distinguish individual markers 24. Thus, the appearance of the markers 24 will inform an observer as to the rotational speed of the ball 10 when thrown. Further, because the markers 24 are wider the alignment cues 20, the rotational speed of the ball 10 can be easily distinguished from its rotational alignment. Moreover, the larger width of the marker 24 will allow an observer to accurately judge the ball's rotational speed even if the ball's rotational alignment is poor and the ball 10 is wobbling significantly.

It should be noted that the rotational alignment cue 20, the rotational speed cues or markers 24, and finger-positioning pads 26 may each have a unique color different from the majority of the surface area of the ball 10, in order to more easily allow an observer to distinguish these cues from each other and the majority of the surface area of the ball 10. For example, the panels 16 can be orange while the seams 18 may be black, just as with a conventional basketball. The rotational speed cues 24, however, may be yellow, so as to be easily recognizable to the human eye. Alignment cue 20 may then be a white line, so that it stands out from both the yellow of the rotational speed cues 24 and the orange of the panels 16. By making the colors of the rotational speed cues 24 and the rotational alignment cue 20 visually separable, a player, coach or other observer may individually evaluate the rotational alignment and rotational speed of a shot. Of course, other contrasting color, shade and tint combinations may alternately be used for this purpose.

The basketball 10 may be constructed using conventional methods. For example, the basketball 10 may have an inner bladder. Further, the panels 16 may be formed of a leather or synthetic material, and may have a texture to enhance gripping. A layer of sealing material, such as rubber, may be applied at seams 18. Any type of dyeing laminate, or other coloring process can then be used to color the various features of the ball 10 as described above.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

What is claimed is:

1. A ball, comprising:

a rotational alignment cue for visibly demonstrating a rotational alignment of the ball during rotation;

a plurality of rotational speed cues for visibly demonstrating a rotational speed of the ball during rotation, the rotational speed cues having a textured surface that is different from a texture of a majority of a surface area of the ball; and a plurality of hand alignment cues identifying positions on which a player should place one or more hands when shooting the ball, such that the rotational alignment cue is visibly distinguished from the rotational speed cues and the plurality of hand alignment cues, the rotational speed is cues are visibly distinguished from the rotational alignment cue and the plurality of hand alignment cues, and the plurality of hand alignment cues are visibly distinguished from the rotational alignment cue and the rotational speed cues.

2. The ball recited in claim 1, wherein the rotational alignment cue is formed of a plurality of discrete line segments.

3. The ball recited in claim 1, wherein the hand alignment cues include a plurality of finger positioning pads identifying positions at which a player should place one or more fingertips of a shooting hand when shooing the ball.

4. The ball recited in claim 3, wherein the finger positioning pads are positioned at intersections of an equator of the ball with the seams of the ball.

5. The ball recited in claim 3, wherein the hand alignment cues include twelve or more finger positioning pads identifying positions at which a player should place fingertips of a shooting hand when shooting the ball.

6. The ball recited in claim 1, further comprising a plurality of rotational speed cues for visibly demonstrating a rotational speed of the ball during rotation.

7. The ball recited in claim 6, wherein the rotational speed cues are rectangular with a long axis transverse to the rotational alignment cue.

8. The ball recited in claim 6, wherein the rotational speed cues are a different color from the rotational alignment cue.

9. The ball recited in claim 6, wherein the rotational speed cues and the rotational alignment cue are different colors from a majority of a surface area of the ball.

10. The ball recited in claim 1, wherein said textured surface includes a plurality of ridges positioned generally transverse to the rotational alignment cue.

11. The ball recited in claim 1, wherein the plurality of hand alignment cues further includes a stabilizing hand positioning mark located over one or both opposite poles of the ball.

12. The ball recited in claim 11, wherein the plurality of hand alignment cues includes a plurality finger positing pads identifying positions at which a player should place one or more fingertips of a shooting hand when shooting the ball.

13. The ball recited in claim 12, wherein a user may shoot the ball by placing fingers of a left hand at one of the finger positioning pads and a right hand over a stabilizing hand positioning mark, or shoot the ball by placing fingers of a right hand at one of the finger positioning pads and a left hand over a stabilizing hand positioning mark.

14. A ball, comprising:

a rotational alignment cue for visibly demonstrating a rotational alignment of the ball during rotation;

a rotational speed cue for visibly demonstrating a rotational speed of the ball during rotation; and a plurality of hand alignment cues identifying positions on which a player should place one or more hands when shooting the ball, the hand alignment cues including a plurality of finger positioning pads identifying positions at which a player should place one or more fingertips of a shooting hand when shooting the ball, the finger positioning pads being positioned only at intersections of an equator of the ball with seams of the ball.

15. The ball recited in claim 14, wherein one of the finger positioning pads is positioned on either side of each intersection of the equator of the ball with a seam of the ball.

16. The ball recited in claim 14, wherein one of the finger positioning pads is positioned on each intersection of the equator of the ball with a seam of the ball.

17. The ball recited in claim 14, wherein the rotational alignment cue is formed of a plurality of discrete line segments.

18. The ball recited in claim 14, further comprising a plurality of rotational speed cues for visibly demonstrating a rotational speed of the ball during rotation.

19. The ball recited in claim 18, wherein the rotational speed cues are rectangular with a long axis transverse to the rotational alignment cue.

20. The ball recited in claim 18, wherein the rotational speed cues are a different color from the rotational alignment cue.

21. The ball recited in claim 18, wherein the rotational speed cues and the rotational alignment cue are different colors from a majority of a surface area of the ball.

22. The ball recited in claim 18, wherein the rotational speed cues have a textured surface that is different from a texture of a majority of a surface area of the ball.

23. The ball recited in claim 22, wherein said textured surface includes a plurality of ridges positioned generally transverse to the rotational alignment cue.

24. The ball recited in claim 14, wherein the plurality of hand alignment cues further includes a stabilizing hand positioning mark located over one or both opposite poles of the ball.

25. The ball recited in claim 24, wherein the plurality of hand alignment cues include a plurality finger positioning pads identifying positions at which a player should place one or more fingertips of a shooting hand when shooting the ball.

26. The ball recited in claim 25, wherein a user may shoot the ball by placing fingers of a left hand at one of the finger positioning pads and a right hand over a stabilizing hand positioning mark, or shoot the ball by placing fingers of a right hand at one of the finger positioning pads and a left hand over a stabilizing hand positioning mark.

27. A ball, comprising:

a rotational alignment cue for visibly demonstrating a rotational alignment of the ball during rotation;

a rotational speed cue for visibly demonstrating a rotational speed of the ball during rotation; and a plurality of hand alignment cues identifying positions on which a player should place one or more hands when shooting the ball, the hand alignment cues including a plurality of finger positioning pads identifying positions at which a player should place one or more fingertips of a shooting hand when shooting the ball such that each of the finger positioning pads has a different surface texture than other surfaces on the ball.

28. The ball recited in claim 27, wherein the rotational alignment cue is formed of a plurality of discrete line segments.

29. The ball recited in claim 27, wherein the finger positioning pads are positioned at intersections of an equator of the ball with the seams of the ball.

30. The ball recited in claim 27, wherein the hand alignment cues include twelve or more finger positioning pads identifying positions at which a player should place fingertips of a shooting hand when shooting the ball.

31. The ball recited in claim 27, wherein the finger positioning pads are substantially evenly spaced around a circumference of the ball.

32. The ball recited in claim 27, wherein at least one of the finger positioning pads forms a dimple or a raised area.

33. The ball recited in claim 27, further comprising a plurality of rotational speed cues for visibly demonstrating a rotational speed of the ball during rotation.

34. The ball recited in claim 33, wherein the rotational speed cues are rectangular with a long axis transverse to the rotational alignment cue.

35. The ball recited in claim 33, wherein the rotational speed cues are a different color from the rotational alignment cue.

36. The ball recited in claim 33, wherein the rotational speed cues and the rotational alignment cue are different colors from a majority of a surface area of the ball.

37. The ball recited in claim 33, wherein the rotational speed cues have a textured surface that is different from a texture of a majority of a surface area of the ball.

38. The ball recited in claim 37, wherein said textured surface includes a plurality of ridges positioned generally transverse to the rotational alignment cue.

39. The ball recited in claim 27, wherein the plurality of hand alignment cues further includes a stabilizing hand positioning mark located over one or both opposite poles of the ball.

40. The ball recited in claim 39, wherein the plurality of hand alignment cues includes a plurality finger positioning pads identifying positions at which a player should place one or more fingertips of a shooting hand when shooting the ball.

41. The ball recited in claim 40, wherein a user may shoot the ball by placing fingers of a left hand at one of the finger positioning pads and a right hand over a stabilizing hand positioning mark, or shoot the ball by placing fingers of a right hand at one of the finger positioning pads and a left hand over a stabilizing hand positioning mark.

* * * * *